US008448403B1

(12) United States Patent
Wallace

(10) Patent No.: US 8,448,403 B1
(45) Date of Patent: May 28, 2013

(54) WATER CATCHMENT BUILDING BLOCK

(76) Inventor: David Wallace, Fleming Island, FL (US)

( * ) Notice: Subject to any disclaimer, the term of this patent is extended or adjusted under 35 U.S.C. 154(b) by 0 days.

(21) Appl. No.: 13/544,561

(22) Filed: Jul. 9, 2012

(51) Int. Cl.
*F04C 1/00* (2006.01)

(52) U.S. Cl.
USPC ..... 52/607; 52/563; 52/567; 52/570; 405/284

(58) Field of Classification Search
USPC ..... 52/561–564, 566, 567, 570, 596, 52/605–607; 405/284
See application file for complete search history.

(56) References Cited

U.S. PATENT DOCUMENTS

| | | | | |
|---|---|---|---|---|
| 2,594,378 | A | 7/1947 | Baldanza | |
| 3,005,282 | A * | 10/1961 | Christiansen | 446/128 |
| 3,412,502 | A | 11/1968 | Riches | |
| 3,962,842 | A | 6/1976 | Wilhelm | |
| 4,267,662 | A * | 5/1981 | Gordy | 446/89 |
| 4,324,229 | A * | 4/1982 | Risser | 126/603 |
| 4,632,342 | A * | 12/1986 | Skinner | 248/48.2 |
| 4,726,158 | A * | 2/1988 | Fagnoni | 52/79.5 |
| 4,919,635 | A * | 4/1990 | Bertrand | 446/128 |
| 5,832,687 | A * | 11/1998 | Willemsen | 52/592.6 |
| 6,050,044 | A * | 4/2000 | McIntosh | 52/591.1 |
| 6,108,995 | A * | 8/2000 | Bouchard et al. | 52/609 |
| 6,508,038 | B2 | 1/2003 | Al-Ghitta | |
| 6,571,525 | B2 * | 6/2003 | Coleman | 52/592.5 |
| 6,626,609 | B1 | 9/2003 | Kotani et al. | |
| 6,641,452 | B2 | 11/2003 | Racine | |
| 6,648,715 | B2 | 11/2003 | Wiens et al. | |
| 7,076,921 | B2 * | 7/2006 | Spradlin | 52/11 |
| 7,108,577 | B2 | 9/2006 | Peters et al. | |
| 7,231,740 | B2 * | 6/2007 | Jirele | 52/7 |
| 7,509,779 | B2 | 3/2009 | Makovich | |
| 7,694,485 | B1 * | 4/2010 | Siener | 52/590.2 |
| 7,721,491 | B2 | 5/2010 | Appel | |
| 7,757,451 | B2 * | 7/2010 | Lee Lum | 52/574 |
| 7,997,893 | B2 * | 8/2011 | Lee Lum | 425/444 |
| 8,074,419 | B1 | 12/2011 | Humphress et al. | |
| 2003/0079432 | A1 | 5/2003 | Azar | |
| 2003/0082986 | A1 | 5/2003 | Wiens et al. | |
| 2004/0131430 | A1 | 7/2004 | Boys | |
| 2005/0023174 | A1 * | 2/2005 | Lary et al. | 206/509 |
| 2006/0096227 | A1 | 5/2006 | Regina | |
| 2007/0199273 | A1 * | 8/2007 | Wang | 52/604 |
| 2008/0149188 | A1 | 6/2008 | Zimmerman et al. | |
| 2008/0184649 | A1 | 8/2008 | Khan | |
| 2009/0077920 | A1 * | 3/2009 | Korman et al. | 52/606 |
| 2009/0126280 | A1 * | 5/2009 | Radi et al. | 52/2.11 |
| 2010/0223876 | A1 | 9/2010 | Jones | |

(Continued)

*Primary Examiner* — William Gilbert
*Assistant Examiner* — Alp Akbasli
(74) *Attorney, Agent, or Firm* — Glenn E. Gold; Gold & Rizvi, P.A.

(57) ABSTRACT

A housing structure comprising a plurality of hollow blocks having an interlocking opening at the top and bottom; an interlocking handle at the front face; and a receiving cut-out at the rear face, left side, or right side; and wherein the plurality hollow blocks are configured to be vertically stacked to a desirable height and horizontally interconnected to form the base of the housing structure. The housing structure further comprising a plurality of gutter-like sections having an interlocking nozzle at the bottom; and an interlocking system at the left and right ends; and wherein the plurality of gutter-like sections are configured to be interlocked to the top of the housing structure to trap rain water or fill the hollow blocks. A tent-like section can be assembled in the center of the housing structure for forming the roof of the housing structure and aiding in the collecting of rain water.

7 Claims, 12 Drawing Sheets

U.S. PATENT DOCUMENTS

2010/0270219 A1* 10/2010 Block ..... 210/162
2010/0284747 A1 11/2010 Peterson et al.
2010/0307095 A1* 12/2010 Adams ..... 52/562
2011/0088319 A1 4/2011 Koumoudis
2011/0303307 A1* 12/2011 Block ..... 137/357
2012/0227320 A1* 9/2012 Dos Santos ..... 47/79

* cited by examiner

WATER CATCHMENT BUILDING BLOCK

FIELD OF THE INVENTION

The present disclosure generally relates to a system of building blocks used to build temporary structures that are easily assembled and disassembled by unskilled laborers with no prior construction knowledge and no tools. More particularly, the present disclosure relates to a system of hollow blocks that can be easily assembled into a housing structure, while also providing the ability to serve as a reservoir for collecting rain water. The structure can provide permanent or temporary housing depending on the substances used to fill the hollow blocks.

BACKGROUND OF THE INVENTION

The present invention provides an economical, efficient, and accessible solution to the current problem of providing housing to areas having a large population of individuals and families who have become displaced due to natural disasters, war, and poverty. Recent natural disasters occurring in Haiti, India, Japan and the United States have brought national and international attention to the pressing need to provide quick, easy to construct, and economical shelter to what is often thousands to hundreds of thousands of immediately displaced individuals. Some natural disasters have even resulted in the immediate displacement of millions of individuals. This type of housing crisis is also caused by man-made disasters, such as war and poverty.

Tents, mobile homes, and other means of temporary shelter have been provided in the past. Nevertheless, there are a multitude of limitations to the mobile home solution. One limitation is that mobile homes are relatively expensive and may not be readily available in the disaster area. They are also not easily transported. Pre-constructed mobile homes require the use of large trucks, ships, and/or rail vehicles to transport. On-site construction of mobile homes requires tools, special construction knowledge, and typically several personnel to jointly construct the mobile home. When large scale disaster strikes, personnel shortages of personnel able to assist in the relief effort is also a problem. Thus, the mobile home solution may not be economically practicable, quick, or feasible.

Tents also have many drawbacks. They are not very safe as they are very easily entered into. This is a serious drawback because such disasters are often accompanied by rampant theft, discord, rape, and other strife. The issue is aggravated by the fact that there may not be sufficient police enforcement officials to manage such matters. Additionally, tents do not provide much resistance to weather conditions. Tents also require tools to construct and special knowledge of how to construct the tent. Moreover, tents are not comfortable and do not provide additional functionality, such as the ability to store water or the ability to be converted into a permanent structure through the introduction of sand or cement. This added functionality would be particularly useful in areas of rampant poverty, where clean water is scarce and adequate shelter is not common.

Accordingly, there remains a need in the art to provide temporary housing structures that are made of low-cost materials; can be quickly and easily assembled; quickly and easily transported; require no special skills or tools to construct; and have the ability to catch and store water or be converted to a more permanent structure; thereby providing an economical, multi-functional, and easily accessible housing solution to areas having a large number of displaced individuals.

SUMMARY OF THE INVENTION

The present invention is directed to a system of water catchment building blocks that satisfies this need.

In accordance with one embodiment of the present invention, the embodiment provides a system of building blocks comprising:

a plurality of hollow building blocks, each hollow building block comprising:

a cavity, an upper surface, a lower surface, and a plurality of sidewalls extending downwardly from a peripheral edge of the upper surface to a peripheral edge of the lower surface;

the upper surface comprising a first opening configured to vertically interlock to a second opening on the lower surface of a vertically adjacent hollow building block;

the plurality of sidewalls comprising an interlocking projection and an interlocking socket; wherein the interlocking projection is configured to mate with the interlocking socket of a horizontally adjacent hollow building block.

In a second aspect of the system of building blocks, the first opening extends upwardly from the upper surface, forming a projecting mouth through which liquid may enter the cavity.

In yet another aspect, the second opening extends upwardly from the lower surface, forming a recessed mouth through which liquid may exit the cavity.

In another aspect, the system of building blocks further comprises a gutter assembly having a plurality of spouts, each spout configured to vertically interlock to the second opening of a vertically adjacent hollow building block.

In another aspect, the gutter assembly comprises a plurality of gutter assembly sections, each gutter assembly section comprises:

a bottom surface, a left end, and a right end;

the bottom surface comprising at least one of the spouts;

the left end comprising an interlocking tongue; and the right end comprising an interlocking groove; wherein the interlocking groove is configured to engage the interlocking tongue of a horizontally adjacent gutter assembly section.

In another aspect, the gutter assembly is vertically interlocked to a top of a housing base, the housing base formed by vertically and horizontally interlocking the plurality of hollow building blocks.

In another aspect, the system of building blocks further comprises a housing cover, the housing cover configured to provide a protective covering over an interior area formed by a perimeter of the housing base.

In another aspect, the housing cover comprises a plurality of downward sloping surfaces that terminate at the gutter assembly.

In another aspect, the housing cover is water-resistant.

In another aspect, the interlocking projection is a handle.

In another aspect, the hollow building blocks are plastic blow molded blocks.

Introducing another embodiment, a method of building a housing structure from the system of building blocks, comprises the steps of:

vertically and horizontally interlocking a plurality of hollow building blocks to form a housing base;

vertically interlocking a gutter assembly to a top of the housing base; and placing a housing cover over an interior area formed by a perimeter of the housing base.

In yet another aspect, the method further comprises the step of depositing cement into the hollow building blocks.

In yet another aspect, the method further comprises the step of depositing sand into the hollow building blocks.

These and other aspects, features, and advantages of the invention will be further understood and appreciated by those skilled in the art by reference to the following written specification, claims and appended drawings.

BRIEF DESCRIPTION OF THE DRAWINGS

The preferred embodiments of the present invention will hereinafter be described with reference to the accompanying drawings to illustrate and not limit the invention, in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 3. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
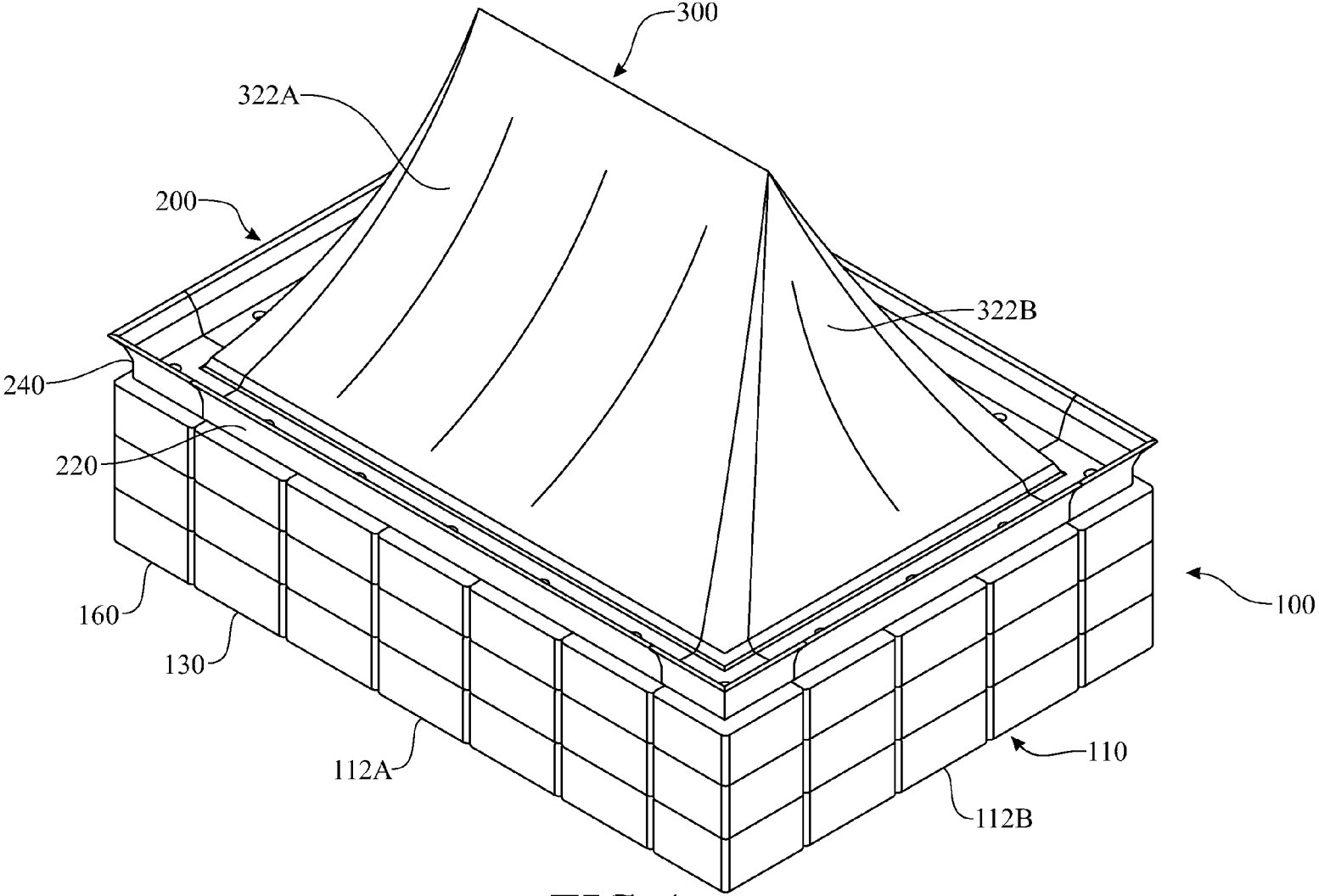
FIG. 1 presents an isometric view of an exemplary housing structure with an exemplary housing covering.
Figure 2:
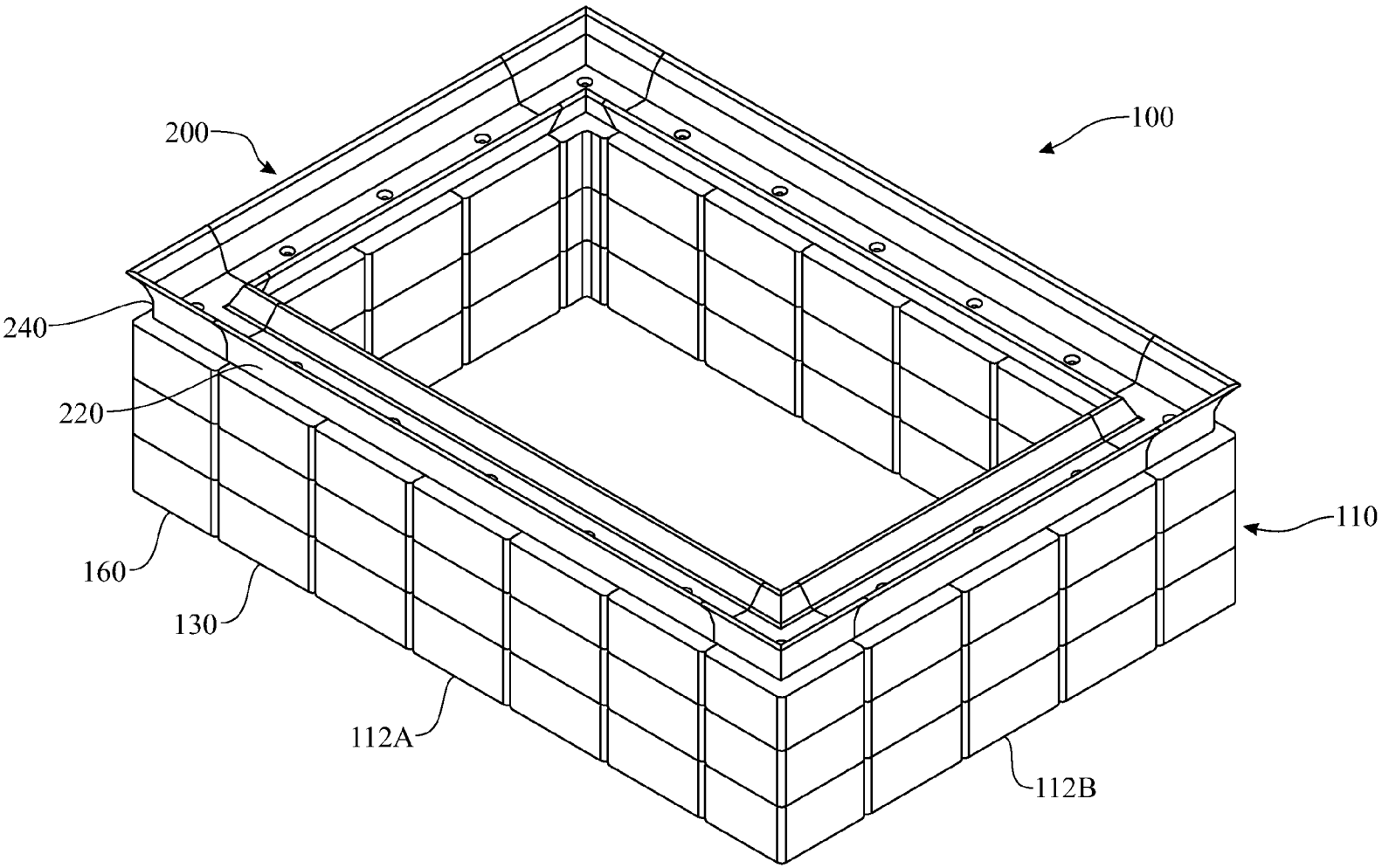
FIG. 2 presents an isometric view of the housing structure originally introduced in FIG. 1, without the housing covering.

A housing structure 100 is presented in FIG. 1, comprising a housing base 110, a gutter assembly 200, and a housing cover 300. The housing base 110 comprises a plurality of vertically and horizontally interlocked side hollow blocks 130 and corner hollow blocks 160. The gutter assembly 200 comprises a plurality of horizontally interlocked side gutter assembly sections 220 and corner gutter assembly sections 240. Furthermore, the gutter assembly 200 is vertically interlocked to the top of the housing base 110. And the housing cover 300 is attached to the gutter assembly 200, forming a roof of the housing structure 100.

Figure 3:
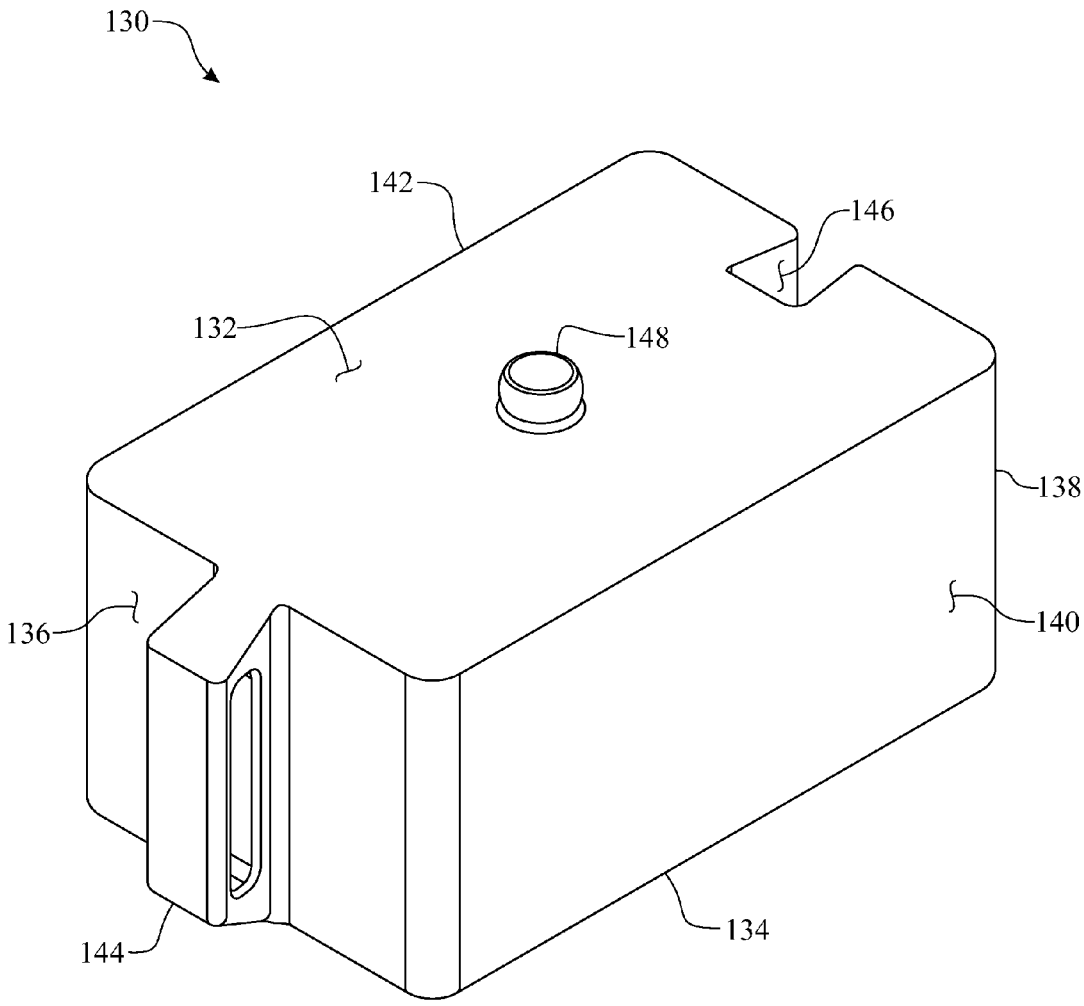
FIG. 3 presents an isometric view of an exemplary side hollow block.
Figure 9:
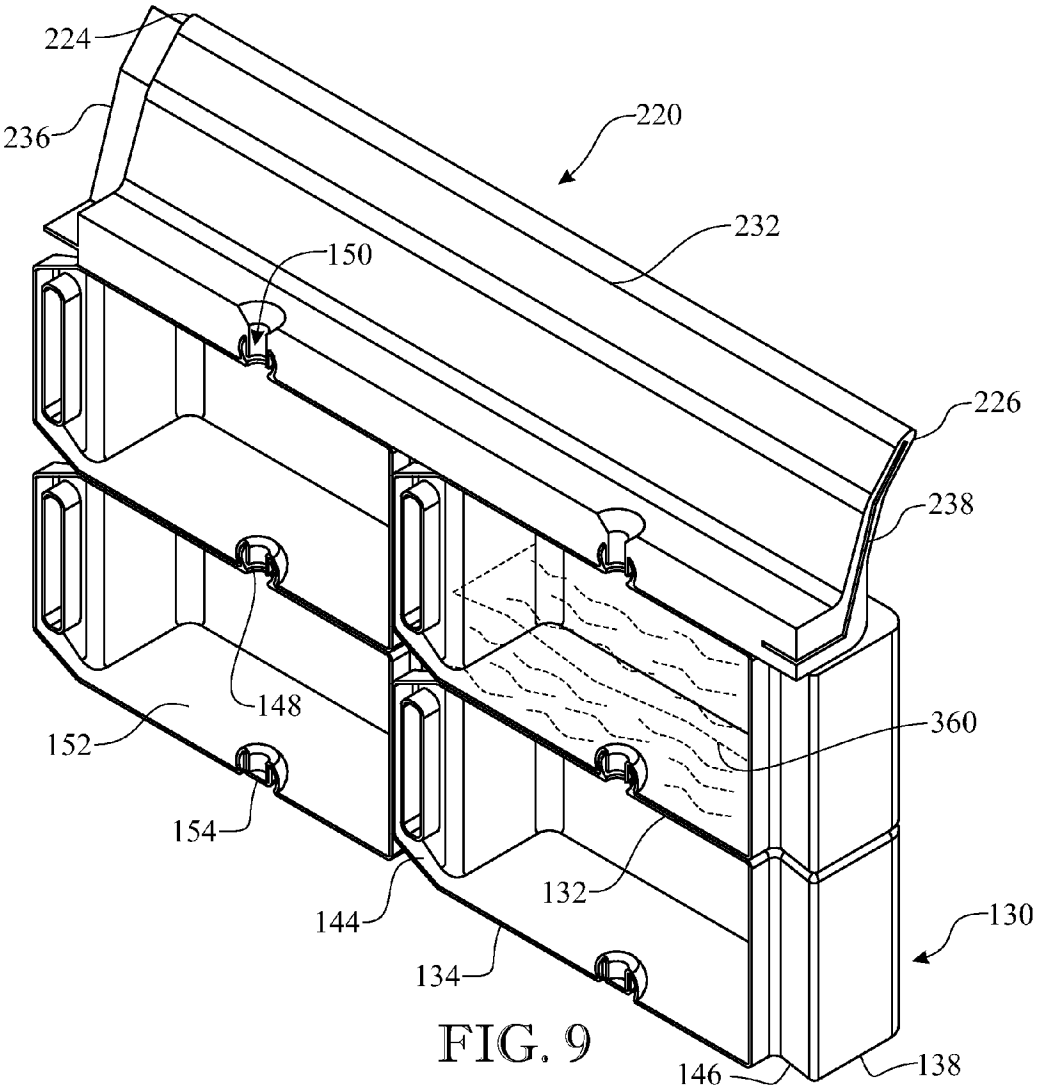
FIG. 9 presents an isometric section view of four vertically and horizontally interlocked side hollow blocks originally introduced in FIG. 5, and a side gutter assembly section, illustrating a horizontally and vertically interlocking configuration.
Figure 10:
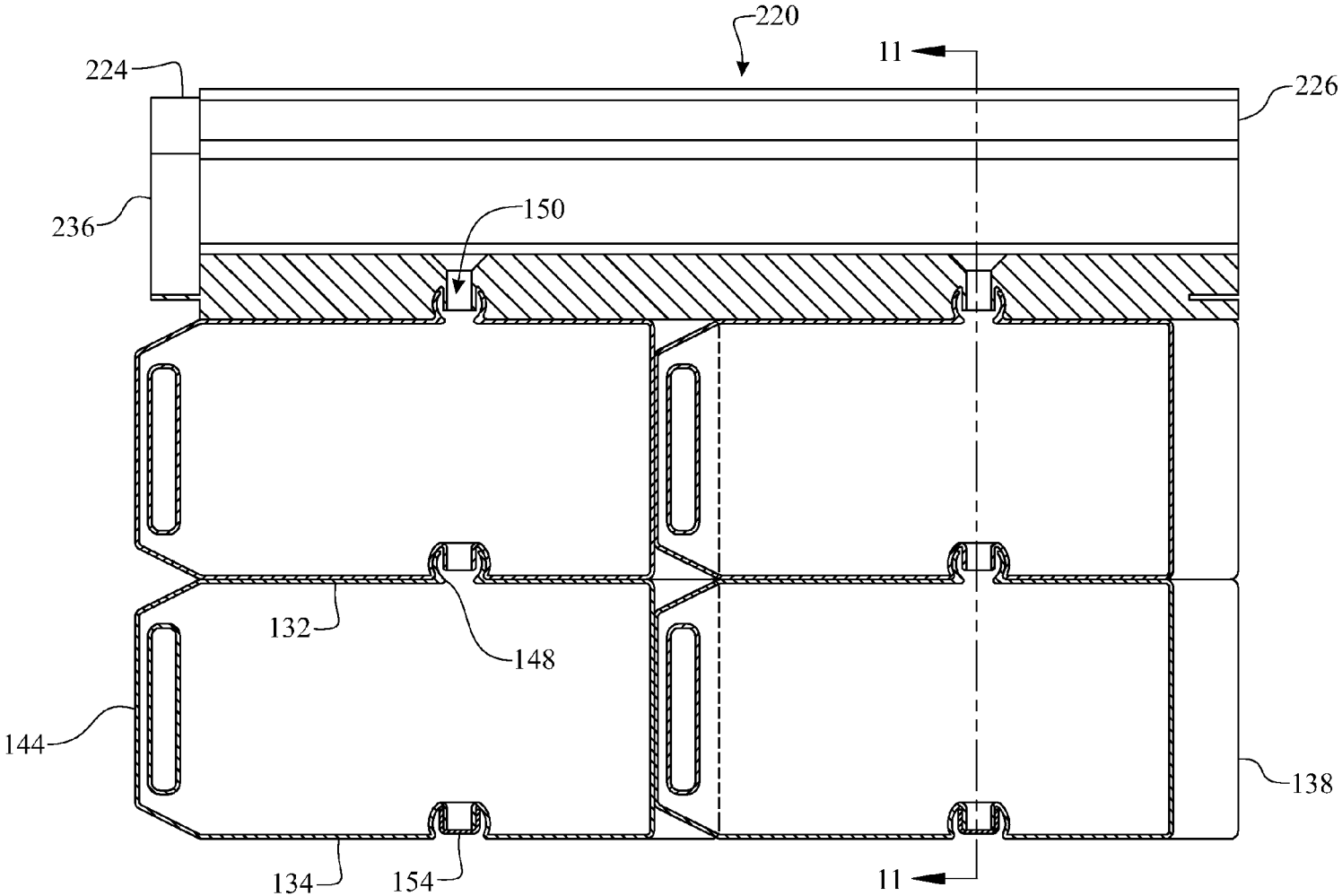
FIG. 10 presents a section view looking outward onto four vertically and horizontally interlocked side hollow blocks originally introduced in FIG. 5, and a side gutter assembly section, illustrating a horizontally and vertically interlocking configuration.

The side hollow block 130 is substantially rectangular in shape, having an upper surface 132, lower surface 134, left side 136, right side 138, front face 140, and rear face 142, as illustrated in FIG. 3. The interior of the side hollow block 130 forms a cavity 152 suitable for holding water 360 as illustrated in FIG. 9. The cavity 152 may also be filled with other materials, such as sand or cement.

A projecting mouth 148 extends upward from the upper surface 132, providing an opening on the upper surface 132 for filling the side hollow blocks 130 with liquid or semi-liquid materials. The projecting mouth 148 can be formed at any location on the upper surface 132, wherein the exemplary projecting mouth 148 is placed in the center of the upper surface 132. The projecting mouth 148 provides the vertical interlocking functionality of the side hollow blocks 130 by serving as a male member. Accordingly, the projecting mouth 148 is sized and shaped to engage with a recessed opening 150 on the lower surface 143 of a vertically adjacent side hollow block 130. The recessed opening 150 extends upward from the lower surface 134, providing an opening on the lower surface 134. This allows water and other materials entering from the top of the housing base 110 to fill the entire housing base 110, including the side hollow blocks 130 that are at the bottom of the housing base 110. The recessed opening 150 provides the vertical interlocking functionality of the side hollow blocks 130 by serving as a female member. Accordingly, the recessed opening 150 is sized and shaped to engage with the projecting mouth 148 on the upper surface 143 of a vertically adjacent side hollow block 130.

An interlocking projection 144 extends outward from the left side 136 of the side hollow block 130, providing the horizontal interlocking functionality of the side hollow blocks 130 by serving as a male member. Accordingly, the interlocking projection 144 is sized and shaped to engage with the interlocking socket 146 on the right side 138 of a horizontally adjacent hollow block 130, 160. As illustrated in FIG. 3, the interlocking projection 144 is preferably shaped as a handle for easy handling of the side hollow block 130 and to provide the side hollow block 130 with an additional use as a jug, suitable for carrying water. The interlocking projection 144 may also be shaped as a dovetail for forming a dovetail connection with the interlocking socket 144 of a horizontally adjacent side hollow block 130. The interlocking socket 146 extends inward from the right side 138 of the side hollow block 130, providing the horizontal interlocking functionality of the side hollow blocks 130 by serving as a female member. Accordingly, the interlocking socket 146 is sized and shaped to engage with the interlocking projection 144 on the left side 136 of a horizontally adjacent hollow block 130, 160. To summarize, the vertical and horizontal interlocking functionality of the side hollow blocks 130 provided by the interlocking projections 144, interlocking sockets 146, projecting mouths 148, and recessed openings 150, as explained above, allows for the easy and secure formation of a wall of the housing base 110, as shown in FIG. 9.

Figure 4:
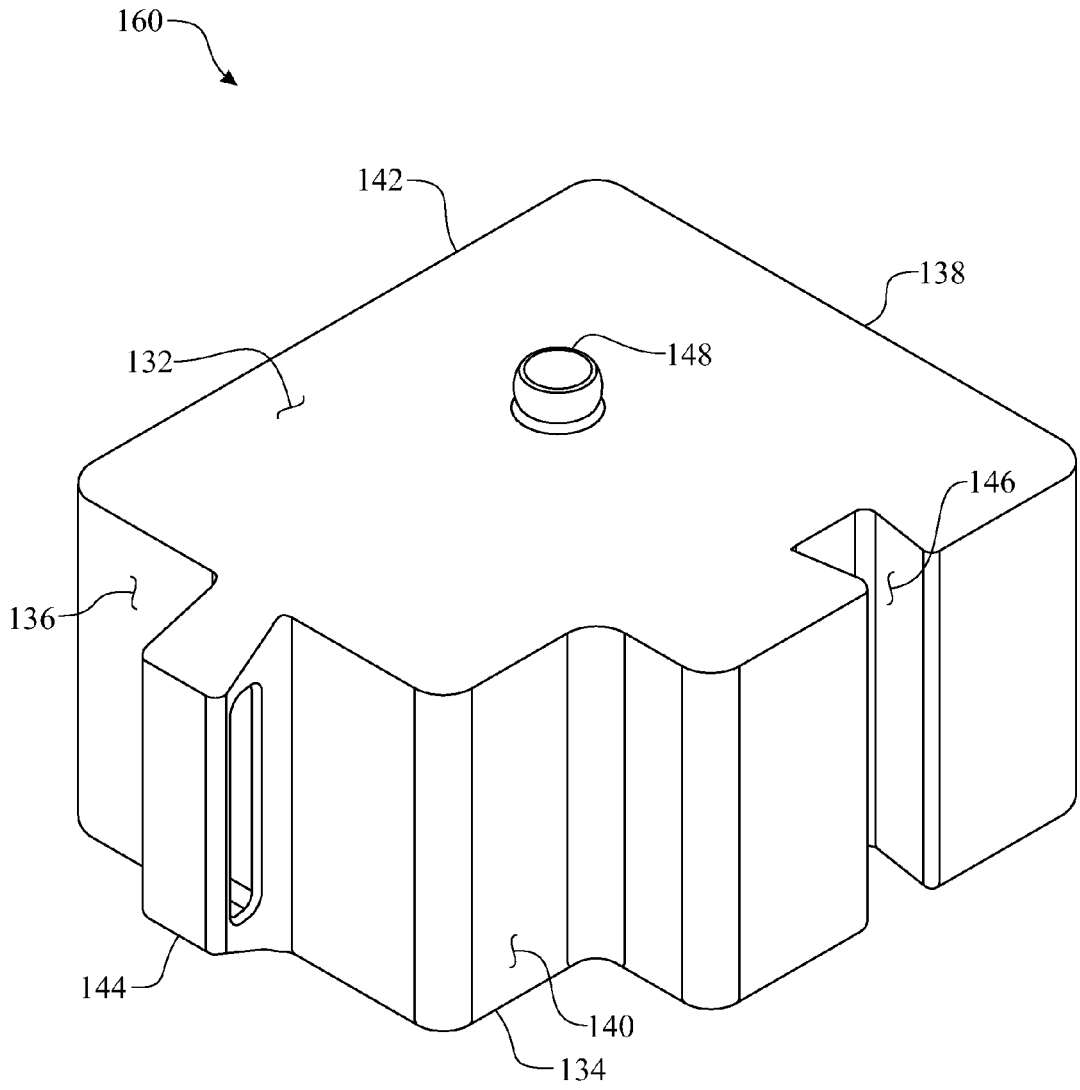
FIG. 4 presents an isometric view of an exemplary corner hollow block.

The corner hollow block 160 has some features similar to that of the side hollow block 130. Similar features of the corner hollow block 160 and the side hollow block 130 are numbered the same. The corner hollow block 160 is sized and shaped to engage the side hollow blocks 130 to complete the perimeter of the housing base 110, wherein the exemplary housing base 110 is rectangular. The corner hollow block 160 comprises an upper surface 132, lower surface 134, left side 136, right side 138, front face 140, and rear face 142, as illustrated in FIG. 4. The interior of the corner hollow block 160 forms a cavity 152 suitable for holding water.

As with the side hollow block 130, the corner hollow block 160 has horizontal and vertical interlocking functionality. The shape of the corner hollow block 160 may, but need not, differ from the shape of the side hollow block 160 in order to provide the ninety degree turn required to complete the perimeter of the housing base 110. Like the side hollow block 130, the corner hollow block 160 comprises a projecting mouth 148, a recessed opening 150, an interlocking projection 144, and an interlocking socket 146, as illustrated in FIG. 4. Any explanation or description, contained herein, of the shape, functionality, or configuration of the side hollow block's projecting mouth 148, recessed opening 150, interlocking projection 144, and interlocking socket 146 applies to that of the corner hollow block 160, except as otherwise stated or implied herein. A primary difference between the side hollow block 130 and the corner hollow block 160 is the configuration of the interlocking projection 144 and socket 146. The interlocking projection 144 and socket 146 are configured on the corner hollow block 160 to complete the perimeter of the housing base 110. Thus, as illustrated in FIG. 4, the exemplary corner hollow block 160 comprises the interlocking projection 144 extending outward from the left side 136 and the interlocking socket 146 extending outward from the front face 140. Accordingly, the interlocking socket 146 of the corner hollow block 160 can engage the interlocking projection 144 of the side hollow block 130, while forming the ninety degree turn required to complete the perimeter of the housing base 110.

The material used to construct the hollow blocks 130, 160 is preferably a heat-resistant polymer. More preferably, the material is plastic, which is a synthetic polymer that is inexpensive and in common use. The hollow blocks 130, 160 are preferably fabricated using a blow molding process and designed to form a rigid, heat-resistant hollow plastic block.

A recessed opening cap 154 can be secured over the recessed opening 150 of each block 130, 160 in contact with the ground in order to prevent leakage of or contamination of liquids inside blocks 130, 160. Accordingly, the recessed opening cap 154 is sized and shaped to engage the recessed opening 150, maintaining a seal for materials contained in the block 130, 160.

Figure 5:
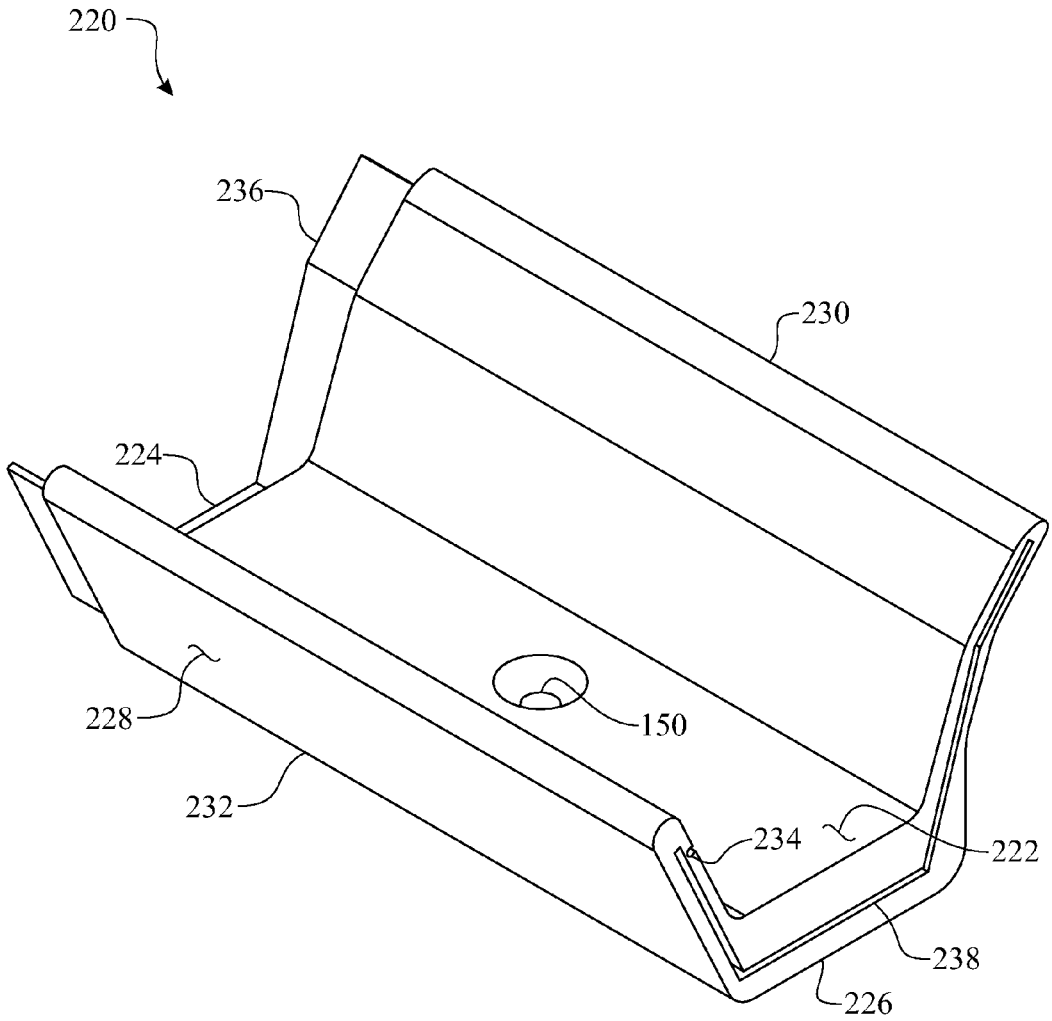
FIG. 5 presents an isometric view of an exemplary side gutter assembly section.

The side gutter assembly section 220 forms a longitudinally extending channel 222 for receiving and dispersing rain water or other materials, such as sand or cement, into the side hollow blocks 130. The side gutter assembly section 220 comprises a left end 224, a right end 226, a front wall 228, a rear wall 230, and a bottom surface 232, as illustrated in FIG. 5. The front wall 228 and rear wall 230 downwardly converge, terminating at the bottom surface 232. The channel 222 is generally "U" or "V" shaped in cross section. The bottom surface 232 may be curved or flat, wherein the exemplary bottom surface 232 is flat, for sitting flush against a flat upper surface 132 of the side hollow block 130. The bottom surface 232 includes a recessed opening 150, forming a spout that directs water into the hollow blocks 130, 160. The recessed opening 150 is sized and shaped to engage the projecting mouth 148 of a vertically adjacent side hollow block 130. An interlocking tongue 236 extends outward from the left end 224, providing the horizontal interlocking functionality of the side gutter assembly section 220 by serving as a male member. Accordingly, the interlocking tongue 236 is sized and shaped to engage with the interlocking groove 238 on the right end 226 of a horizontally adjacent gutter assembly section 220, 240. The interlocking groove 238 extends inward from the right end 226, serving as a female member. As such, the interlocking groove 238 is sized and shaped to engage with the interlocking tongue 236 on the left end 224 of a horizontally adjacent gutter assembly section 220, 240.

Figure 6:
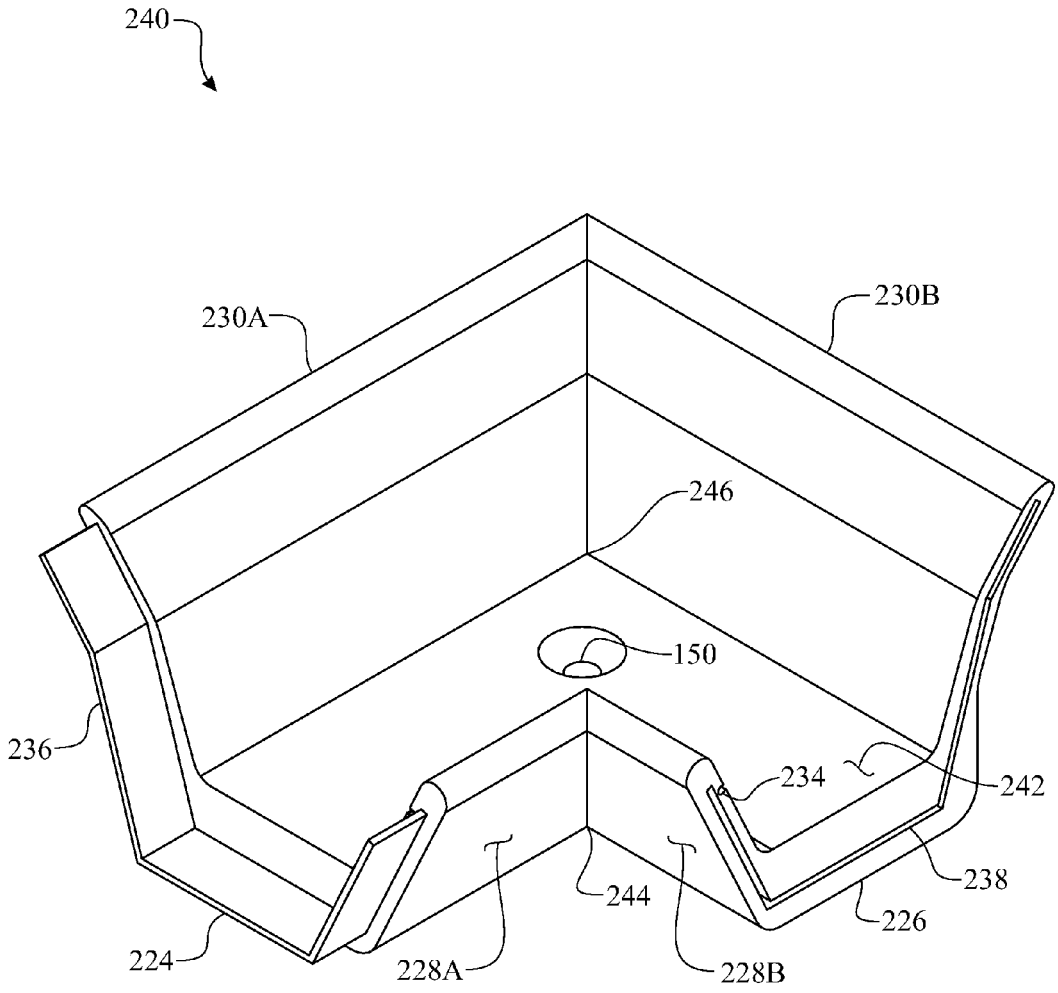
FIG. 6 presents an isometric view of an exemplar corner gutter assembly section.
Figure 7:
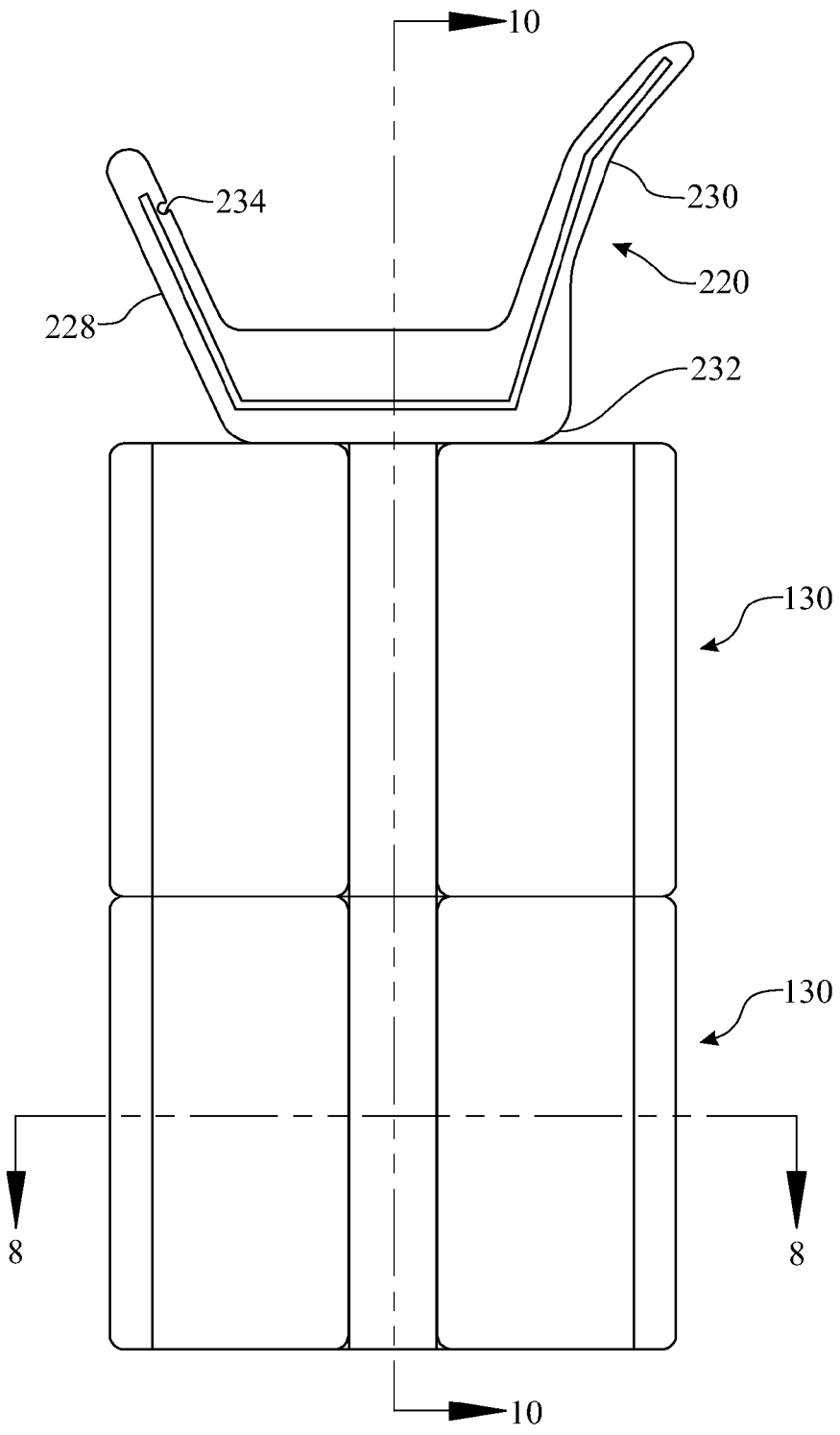
FIG. 7 presents a side view of the side gutter assembly section introduced in FIG. 5 vertically interlocked with two vertically interlocked side hollow blocks originally introduced in FIG. 3, illustrating a vertically interlocking configuration.
Figure 8:
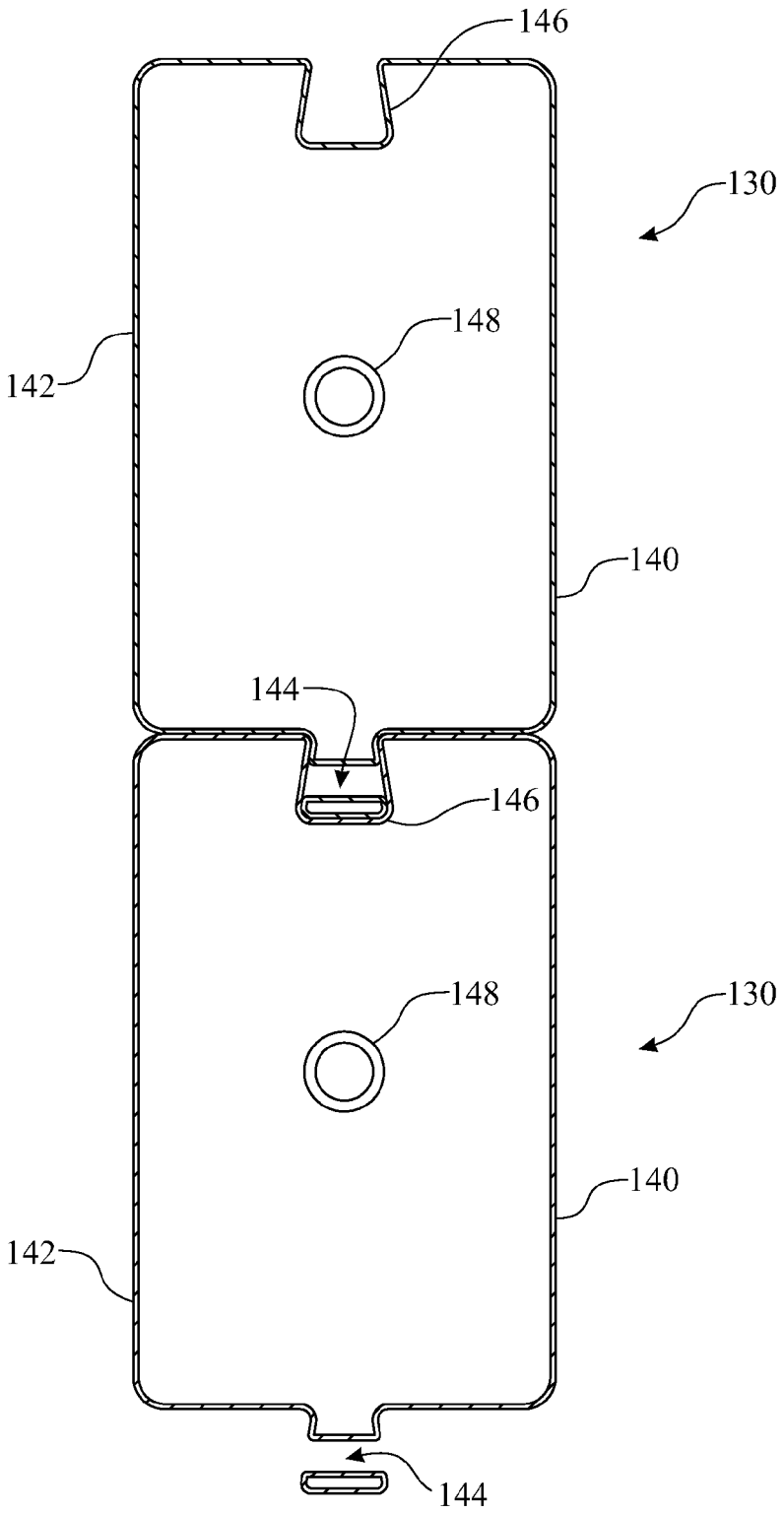
FIG. 8 presents a section view looking downward onto two horizontally interlocked side hollow blocks introduced in FIG. 3, illustrating a horizontally interlocking configuration.

The corner gutter assembly section 240 has some features similar to that of the side gutter assembly section 220. Similar features of the corner gutter assembly section 240 and the side gutter assembly section 220 are numbered the same. The corner gutter assembly section 240 is sized and shaped to engage the side gutter assembly section 220 to complete the perimeter of the gutter assembly 200, wherein the exemplary gutter assembly 200 is rectangular. The corner gutter assembly section 240 forms an L-shaped channel 242 for receiving and dispersing rain water or other materials, such as sand or cement, into the corner hollow blocks 160. The corner gutter assembly section 240 comprises a left end 224, a right end 226, a front wall 228, a rear wall 230, and a bottom surface 232, as illustrated in FIG. 6. The front wall 228 and rear wall 230 downwardly converge, terminating at the bottom surface 232, which, for the corner gutter assembly section 240, is L-shaped. As a result, the front wall 228 of the corner gutter assembly section 240 is L-shaped, having two perpendicular sections 228A, 228B, meeting at the front right angle corner 244 of the bottom surface 232. The rear wall 230 of the corner gutter assembly section 240 is also L-shaped, having two perpendicular sections 230A, 230B, meeting at the rear right angle corner 244 of the bottom surface 232. The bottom surface 232 may be curved or flat, wherein the exemplary bottom surface 232 is flat, for sitting flush against a flat upper surface 132 of the corner hollow block 160. Like the side gutter assembly section 230, the corner gutter assembly section 240 comprises the recessed opening 150, the interlocking tongue 236, and the interlocking groove 238. Any explanation or description contained herein, of the shape, functionality, or configuration of the side gutter assembly section's 220 recessed opening 150, interlocking tongue 236, or interlocking groove 238 applies to that of the corner gutter assembly section 240, except as otherwise stated or implied herein.

Figure 11:
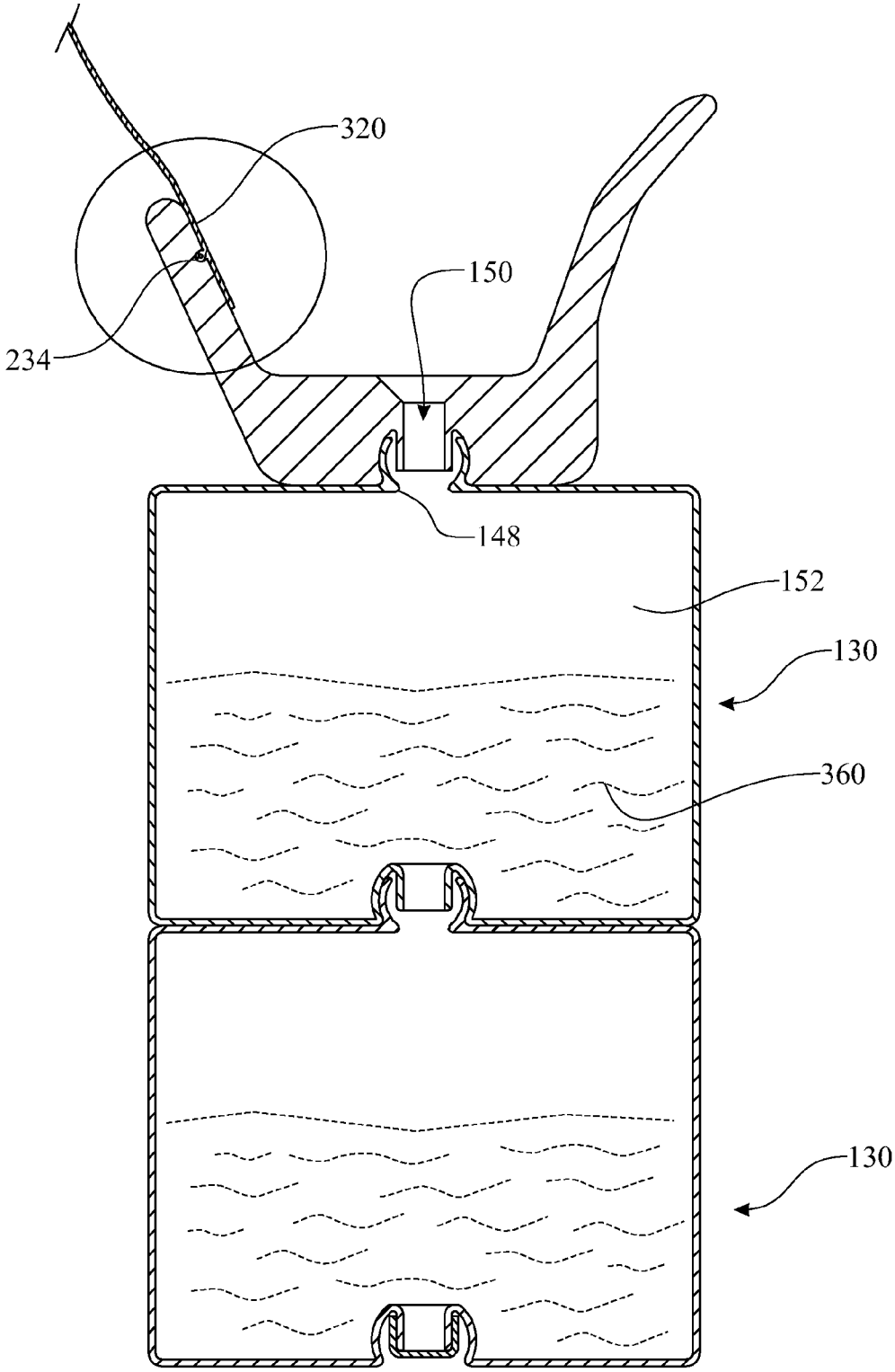
FIG. 11 presents a section view of the side gutter assembly section originally introduced in FIG. 5, vertically interlocked with two vertically interlocked side hollow blocks originally introduced in FIG. 3, illustrating a vertically interlocking configuration.
Figure 12:
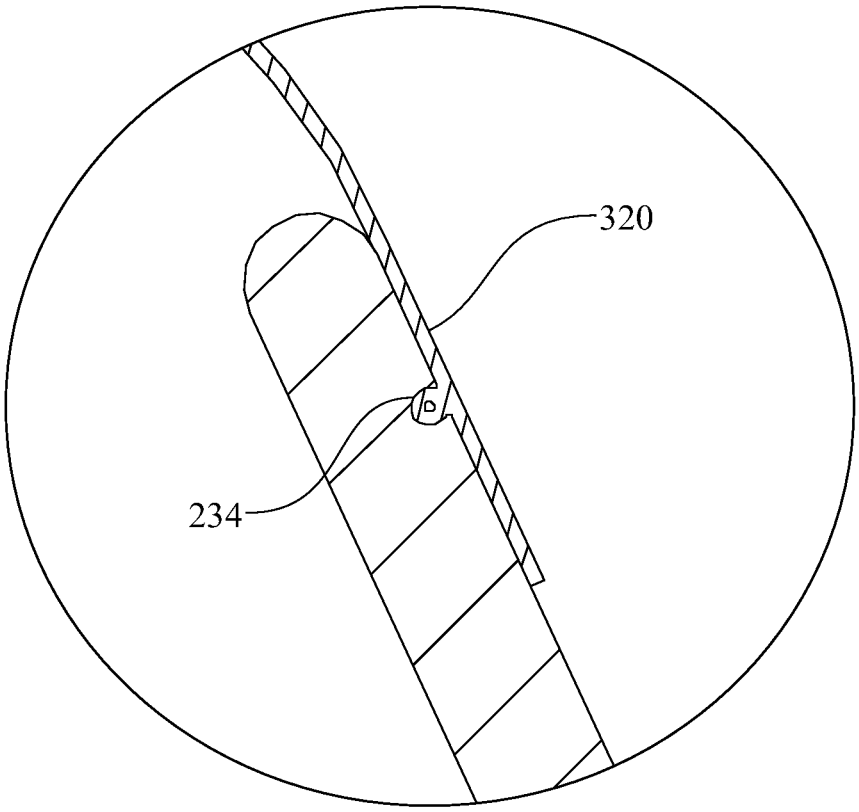
FIG. 12 presents an enlarged view of the housing cover attachment feature to the side gutter attachment feature originally introduced in FIG. 11.

The front wall 228 and/or rear wall 230 of the gutter assembly section 220, 240 may comprise a gutter assembly attachment feature 234. The gutter assembly attachment feature 234 may be formed in any configuration that will allow the attachment or fastening of the housing cover 300 to the gutter assembly 200. The exemplary gutter attachment feature 234 is a notch extending across the inner surface of the front wall 228. As illustrated in FIG. 11, the gutter attachment feature 234 is configured as a female member to receive a housing cover attachment feature 320, which is the male member.

The housing cover 300 functions as a roof of the housing structure 100. The housing cover 300 can be in any configuration that provides a protective covering over the interior area 114 formed by the perimeter of the four housing base walls 112A, 112B, 112C, 112D. The housing cover 300 may be flat or curved. The housing cover 300 may be stiff or flexible. The housing cover 300 may have an approximately rectangular, triangular, or trapezoidal cross section. Of course, other shapes and cross-sectional forms are also possible. The housing cover 300 is preferably configured to aid in the collection of rain water. Thus, the housing cover 300 is preferably made of a water-resistant material and the housing cover 300 preferably comprises a plurality of downward sloping surfaces 322A, 322B that terminate at the gutter assembly 200, for channeling rain water into the gutter assembly 200. As illustrated in FIG. 1, the exemplary housing cover 300 is a tent-like structure, supported by two poles (not shown) that extend vertically beyond the height of the housing base 110, the housing cover 300 forming an approximately triangular cross section and the housing cover 300 comprising four downward sloping surfaces 322A, 322B (322C, 322D not shown) that terminate at the gutter assembly 200.

The housing cover 300 may comprise a housing cover attachment feature 320. The housing cover attachment feature 320 may be formed in any configuration that will allow the attachment or fastening of the housing cover 300 to the gutter assembly 200. The exemplary housing cover attachment feature 320 is a bulbous shaped snap, as illustrated in feature 11. The housing cover attachment feature 320 is configured as a male member, for engaging the gutter assembly attachment feature 234, which is the female member.

In use, a constructing party seals the hollow blocks 130, 160 that will be in contact with the ground by engaging the recessed openings 150 with the recessed opening caps 154 in order to prevent leakage or contamination of the contents of the blocks 130, 160. The constructing party vertically and horizontally interlocks a plurality of hollow blocks 130, 160 to form a housing base 110 that is the length, width, and height desired by the constructing party. The constructing party vertically interlocks the gutter assembly sections 220, 240 to the upper surfaces 132 of the hollow blocks 130, 160 that form the top of the housing base 110. The gutter assembly sections 220, 240 are horizontally interlocked to each other to form the gutter assembly 200. The housing cover 300 is placed over the interior area 114 formed by the perimeter of the housing base 110. The housing cover 300 may be supported by poles or other support structures. The constructing party secures the housing cover 300 to the gutter assembly 200 by engaging the gutter attachment features 234 to the corresponding housing cover attachment features 320. If and when it rains, rain water landing on the housing cover 300 is gravity-fed and channeled by the housing cover's 300 downward sloping surfaces 322A, 322B (322C, 322D not shown) into the gutter assembly 200. The gutter assembly 200 channels the water into the hollow blocks 130, 160 such that the entire housing base 110 can serve as an above the ground cistern, collecting and holding water, either for later use or as added stability for the housing structure 100. As the housing base 110 fills with water, it becomes more stable because of the additional weight of the water.

If the constructing party desires to or is required to move to a different location, the housing structure 100 may be easily disassembled and transported to another location. The constructing party may detach the housing cover 300 and disassemble the gutter assembly sections 220, 240 and hollow blocks 130, 160. A rope may be placed through the handles 144 of the hollow blocks 130, 160 and the rope knotted or tied to secure the hollow blocks 130, 160 for easy transport to the new location. The housing structure 100 may be transported and reassembled at the new location.

If a permanent shelter is desired, the constructing party may fill the hollow blocks 130, 160 with sand or cement. If a cement structure is desired, the constructing party may be required to be instructed with such special knowledge or obtain the assistance of one who possesses the necessary skill.

The hollow blocks 130, 160 and housing structure 100 provide several advantages over the current art, including but not limited to providing the ability to collect and channel rain water into the housing structure 100, for storage, use, or added stability. The downward sloping surfaces 322 gravity-feed rain water into the gutter assembly 200, which channels the rain water into the hollow blocks 130, 160 through the recessed openings 150. The hollow blocks 130, 160 may also be filled with other materials such as cement or sand for forming a more solid, safe, and permanent housing structure. The hollow blocks 130, 160 may be constructed using inexpensive and readily available materials and processes, such as plastic blow molding. Moreover, the inclusion of the interlocking features 144, 146, 1468, 150, 233, 236, 238 allow the housing structure 100 to be assembled and disassembled relatively quickly by a single constructing party with no tools, no special construction knowledge, and no reading ability. The hollow blocks 130, 160 may also be easily transported to another location by the constructing party by putting a rope through the handles 144. The present invention does not require that all of the advantageous features be incorporated into every embodiment.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A system of building blocks, comprising:

a plurality of hollow building blocks, each hollow building block comprising:

a cavity, an upper surface, a lower surface, and a plurality of sidewalls extending downwardly from a peripheral edge of said upper surface to a peripheral edge of said lower surface;

said upper surface comprising a first opening configured to vertically interlock to a second opening on said lower surface of a vertically adjacent hollow building block, wherein said first opening extends upwardly from said upper surface, forming a projecting mouth through which liquid may enter said cavity and wherein said second opening extends upwardly from said lower surface, forming a recessed mouth through which liquid may exit said cavity;

said plurality of sidewalls comprising an interlocking projection and an interlocking socket, wherein said interlocking projection is configured to mate with said interlocking socket of a horizontally adjacent hollow building block; and a gutter assembly having a plurality of spouts, each spout configured to vertically interlock to said second opening of a vertically adjacent hollow building block, wherein said gutter assembly comprises a plurality of gutter assembly sections, each gutter assembly section comprising:

a bottom surface, a left end, and a right end;

said bottom surface comprising at least one of said spouts;

said left end comprising an interlocking tongue; and said right end comprising an interlocking groove; wherein said interlocking groove is configured to engage said interlocking tongue of a horizontally adjacent gutter assembly section.

2. A system of building blocks as recited in claim 1, wherein said gutter assembly is vertically interlocked to a top of a housing base, said housing base formed by vertically and horizontally interlocking said hollow building blocks.

3. A system of building blocks as recited in claim 2, further comprising a housing cover, said housing cover configured to provide a protective covering over an interior area formed by a perimeter of said housing base.

4. A system of building blocks as recited in claim 3, wherein said housing cover comprises a plurality of downward sloping surfaces that terminate at said gutter assembly.

5. A system of building blocks as recited in claim 4, wherein said housing cover is water-resistant.

6. A system of building blocks as recited in claim 1, wherein said interlocking projection is a handle.

7. A system of building blocks as recited in claim 1, wherein said hollow building blocks are plastic blow molded blocks.

* * * * *